United States Patent [19]

Eickmann

[11] Patent Number: 4,685,380

[45] Date of Patent: Aug. 11, 1987

[54] MULTIPLE STROKE RADIAL PISTON MACHINE

[76] Inventor: Karl Eickmann, 2420 Isshiki, Hayama-machi, Kanagawa-ken, Japan

[21] Appl. No.: 429,649

[22] Filed: Sep. 30, 1982

Related U.S. Application Data

[62] Division of Ser. No. 344,110, Jan. 29, 1982, abandoned, which is a division of Ser. No. 244,110, Feb. 7, 1980, abandoned.

[51] Int. Cl.[4] ..... F01B 13/06

[52] U.S. Cl. ..... 91/488; 91/491

[58] Field of Search ..... 91/488, 491, 492

[56] References Cited

U.S. PATENT DOCUMENTS

| | | | |
|---|---|---|---|
| 2,101,829 | 12/1937 | Benedek | 91/498 |
| 2,209,224 | 7/1940 | Ernst | 91/498 |
| 2,276,368 | 3/1942 | Benedek | 91/492 |
| 2,938,504 | 5/1960 | Wadefelt | 91/498 |
| 3,255,706 | 6/1966 | Ecckmann | 91/488 |
| 3,789,741 | 2/1974 | Hallberg | 91/488 |
| 3,828,653 | 8/1974 | Acdinger et al. | 91/488 |

FOREIGN PATENT DOCUMENTS

| | | | |
|---|---|---|---|
| 447172 | 3/1948 | Canada | 91/492 |
| 2552677 | 12/1976 | Fed. Rep. of Germany | 91/491 |
| 972097 | 1/1951 | France | 91/498 |
| 29412 | 12/1967 | Japan | 91/491 |
| 169013 | 9/1921 | United Kingdom | 91/204 |
| 829241 | 9/1958 | United Kingdom | 91/492 |
| 249940 | 6/1970 | U.S.S.R. | 91/488 |
| 432304 | 7/1975 | U.S.S.R. | 91/488 |
| 500366 | 1/1976 | U.S.S.R. | 91/491 |

*Primary Examiner*—Carlton R. Croyle
*Assistant Examiner*—Paul F. Neils

[57] ABSTRACT

The former art provides multi stroke hydrostatic motors, which perform at a single revolution of the rotor multiple inward and outward strokes of the pistons. A high torque was thereby obtained. The invention discovers, that the known multi stroke motors are still too heavy, obtain small overall efficiencies and their power per size and weight is limited because the known motors failed to provide means to carry the tangential loads by fluid pressure power. The invention increases the power and efficiency of multiple stroke motors by the provisions of control means to control the flow of fluid pressure into pockets open to the piston faces and cylinder walls, whereby the torque of the rotor is transferred from the pistons to the cylinder walls by pressure in fluid in the pockets. The invention also provides means to enlarge the stroke of the pistons in a given size and weight of the device. The fluid pressure pockets make high pressures possible and the angles of inclination of the guide faces can be increased. The torque of the device of a given size becomes multiplied and the efficiency of the device increases by the application of the provisons of the invention.

21 Claims, 22 Drawing Figures

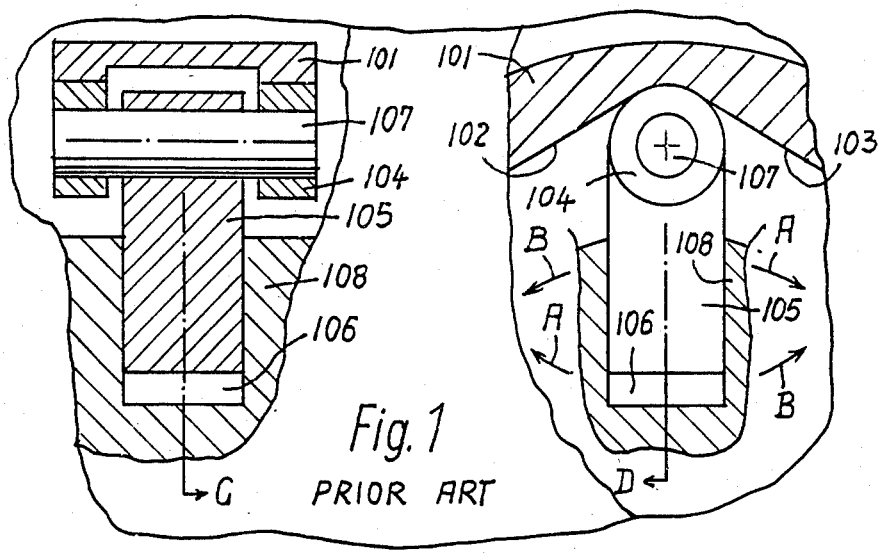
Fig. 1
PRIOR ART
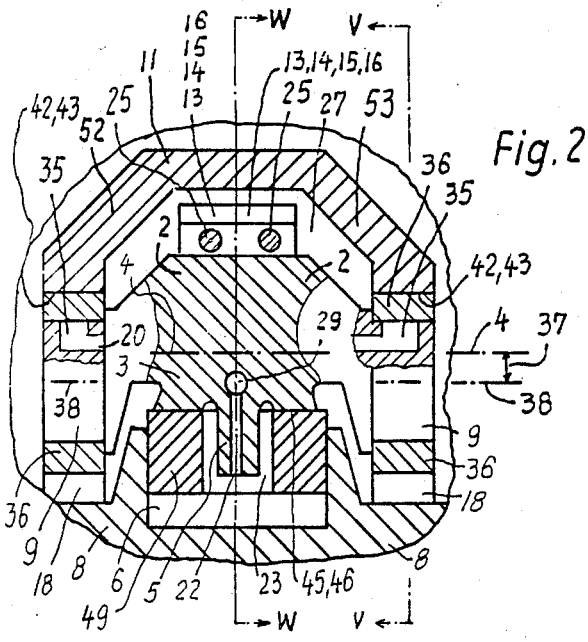
Fig. 2A
Fig. 2B
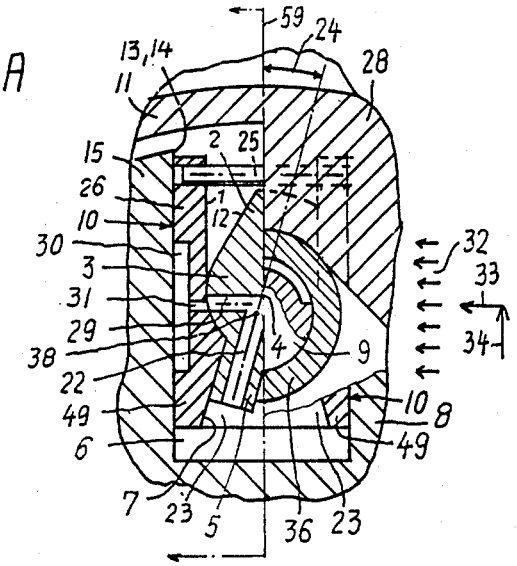
Fig. 3A
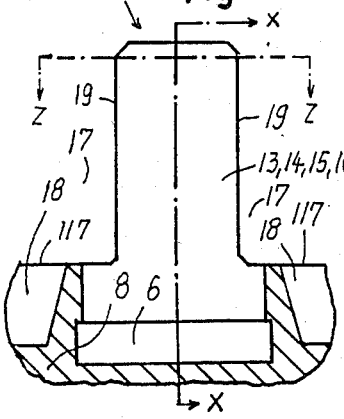
Fig. 3B
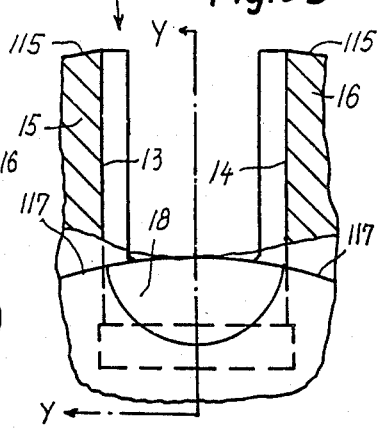
Fig. 3C
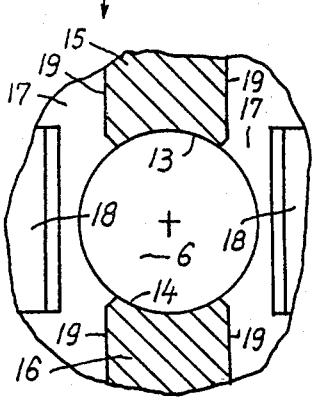

SCALE OF DRAWINGS
0 10 20 30 40 50 60 70 80 90 100 mm
0 12 24 °α 36 48 60 72
3 PISTONS
2 PISTONS
1 PISTON
0
0° 12° 24° 36° 48° 60° 72°
P-5
P-2
P-5
P-4
P-1
P-6
P-3
P-6
0° 10° 20° 30° °α 50° 60° 70°

36
4
37
38
23
49
30
P-1
43
44
α
6
106
STROKE
P-2
P-6
602
15
16
19
β
P-3
P-5
8
P-4
603
604
11

MULTIPLE STROKE RADIAL PISTON MACHINE

CROSS-REFERENCE TO A RELATED APPLICATION

This is a divisional application of my patent application Ser. No. 344,110 which was filed on Jan. 29, 1982 which is now abandoned.

Application Ser. No. 344,110 is a divisional of application Ser. No. 119,349, which was filed on Feb. 7, 1980; benefit of which is claimed herewith. Application Ser. No. 119,349 is now abandoned.

BACKGROUND OF THE INVENTION

It is custom to use multi-stroke hydrostatic motors as high-torque motors. Compared to single stroke motors the multi-stroke motors give a higher torque.

After temporary successes and applications the number of multi-stroke motors has now decreased.

The invention therefore inquires deeply into the technology of multi-stroke motors and discovers the reasons why the common multi-stroke motors have lost so many applications.

After the mentioned deep injury into the reasons of partial failure, the invention discloses novel means, which increase the power and efficiency of multi-stroke motors or pumps so drastically, that the novel motors are now capable of higher power per size and weight and at the same time are capable of working with a higher overall efficiency.

FIELD OF THE INVENTION

The invention deals exclusively with fluid motors or pumps, wherein each piston performs at a single revolution of the rotor a plurality of power strokes and reciprocal strokes.

DESCRIPTION OF THE PRIOR ART

The prior art provides a number of multi-stroke motors, but seldom multi-stroke pumps. The multi-stroke device is especially suitable for high torque motors of low speed.

In the former art the rotor has working chambers, commonly radially extending cylinders, wherein pistons reciprocate. The pistons extend outwards of the pistons and carry radially outwards of the rotor roller or other guide members which are rolling along a multi-stroke cam in the housing of the device. The multi-stroke cam is provided with inwardly and outwardly inclined faces, wherealong the rollers run and thereby move the pistons inwards in the cylinders or allow them or force them to move outwards in the cylinders.

The inclination of the mentioned inclined faces actuates a tangential or lateral force onto the piston, when the piston is subjected to pressure in fluid in the respective cylinder. In other words, the radially directed force of the pressure in fluid in the cylinder onto the bottom of the respective piston is transformed into a radial and a tangential component of forces by the angle of inclination of the respective guide face of the stroke guide. The mentioned tangential component of force is sometimes also called a lateral force, because when seen in the direction of the axis of the piston, the tangential force acts not in the direction of the axis of the piston but laterally thereto. Seen in the overall structure of the device, the description as tangential force appears to be more proper, because the force acts in the direct direction of the torque, which is a tangential direction relative to the rotor.

The mentioned lateral or tangential component of force on the piston is during the power stroke of the piston transferred in the former art by the outer face of the piston onto the wall of the cylinder and thereby the rotor is revolved and obtains a torque.

LIMITATIONS OF THE FORMER ART

The multi-stroke motors of the former art are limited to rather softly inclined inward and outward guide faces, because steeply inclined guide faces would exert such a great tangential force onto the piston, that the piston would bind or weld to the cylinder wall, because the surface pressure between the faces would become too high. The oil film would become pressed away between the faces. This first limitation restricted the torque transferable per piston of the unit.

The multi stroke motors of the former art had all the transfer means between the guide faces and the pistons outwardly of the rotor and this caused the radial dimensions of the device to become too large. The big radial diameters then forced the rollers to run with high speed along the guide faces. That built up in friction forces in the rollers and caused a further limitation of the former art.

The transfer of torque by the mechanical outer faces of the pistons to the mechanical cylinder walls occurred under a bad friction coefficient. That also restricted the efficiency of the devices and provided another limitation of the former art.

Since the transfer of tangential force took place radially outward of the cylinder, the piston tended under the lateral forces to tilt in the cylinder. That caused friction on the bottom portion of the outer face of the piston on one side and on the upper portion of the piston face on the other side. This friction was very considerable and caused yet another limitation of the devices of the former art.

The tendency to tilt the pistons in the cylinders demanded a long piston guide within the cylinders and that again demanded a large radial size of the device and provided the limitation of the former art.

Whatever the former art tried, it led to devices of large dimension per a given torque or power and every increase in pressure reduced the length of the piston stroke or increased the friction and thereby limited the capability of improvement of the former art devices, because the former art failed to discover the main causes of the limitations and unreliabilities under higher pressures and strokes.

LIMITATIONS OF TRANSFER OF TECHNOLOGIES

There is reliable technology in the art of one-stroke devices, which perform a single power stroke at a single revolution of the rotor per piston. For example in a great number of my elder patents.

However, this technology could not be transferred from the one-stroke devices to the multi-stroke devices, because the one-stroke or single stroke-devices demand an annular guide face as guide face for the piston stroke. Piston shoes which have an outer face complementary to the mentioned annular guide face slided sealingly along the annular guide face. The piston shoes pivoted in beds in the pistons. The pivot-bars of the pistons shoes controlled a flow of fluid into fluid pressure pockets in the piston walls.

But, the multi-stroke motors or devices could obtain the multi-strokes only by the provision of non-annular guide faces, namely of those with outwardly and inwardly alternatingly inclined guide faces. Along these non-annular or non-circular faces the outer faces of the piston shoes of single stroke devices could not slide without opening their fluid pressure pockets of the hydrostatic bearings in the outer faces of the piston shoes. Further, the piston shoes would have to pivot suddenly at change from inward to outward stroke under open hydrostatic bearings.

Thus, a combination of the former art of single stroke radial piston devices with multi stroke radial piston devices was not possible.

SUMMARY OF THE INVENTION

The invention discovers, that very drastic and novel steps must be taken in order to obtain an advancement of the multi-stroke devices. These steps have to be:

First: The stroke of the pistons must be increased per given size in order to increase the power.

Second: Tangential fluid pressure fields must be set between the piston walls and the cylinder walls in order to be able to carry the tangential load.

Third: Means must be found to control the flow of fluid pressure into the fluid pressure pockets during power strokes and to cut the supply of pressure off at the reciprocal strokes.

Fourth: The actuation area of the tangential load transfer onto the piston must be transferred from a location radially outward of the cylinder to a location inwards of a cylinder or along a cylinder wall portion.

Fifth: The inclination angle of the stroke guide faces must be increased for extremely high torque applications, and, sixth: The means to improve the devices must be in balance with each other and complement each other in order that disturbance of one of the features by the other or others becomes prevented.

The invention now discovers the means, which can materialize the required steps and applies them singly or, in most cases, in combination.

More details of the aims and objects of the invention, as well as the steps to be taken, will become apparent from the description of the preferred embodiments and from the claims. The appended claims form thereby a portion of the description of the invention, its aims and objects or its embodiment(s).

As far as the word "pivotion" is used in this specification or claims it defines "a pivotal movement". The term "pivotion" is known from my U.S. Pat. No. 4,387,866.

BRIEF DESCRIPTION OF THE DRAWINGS

FIG. 1 shows in section a sample of the former art.

FIG. 2 shows in sectional views 2-A and 2-B one embodiment. The word "embodiment" defines in this application an embodiment of the inventi9n.

FIG. 3 shows a piston of an embodiment in sectional views 3-A, 3-B and 3-C.

Figure 4B:
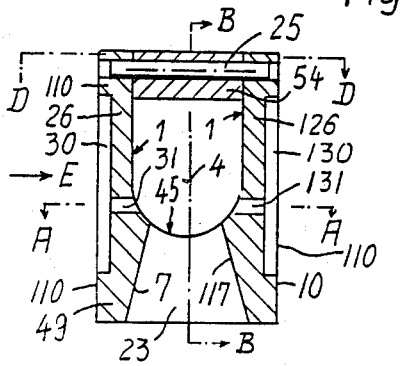
FIG. 4 shows other portions of an embodiment in sectional views 4-A to 4-E.
Figure 4A:
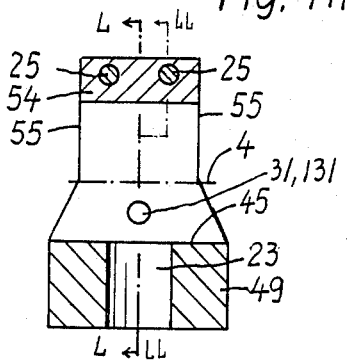
Figure 4D:
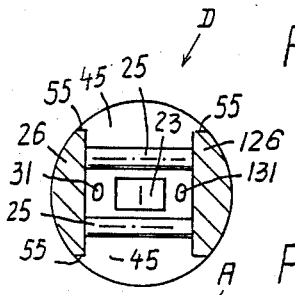
Figure 4C:
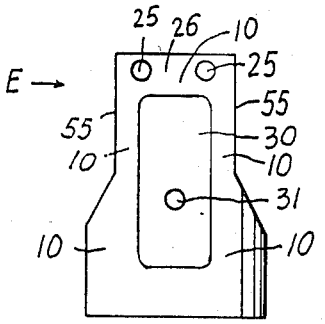
Figure 4E:
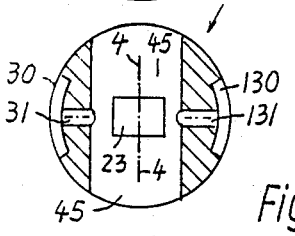
Figure 5B:
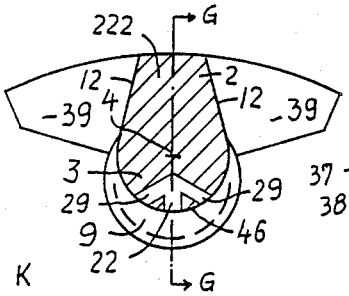
FIG. 5 demonstrates a stroke transfer body of an embodiment 5-A to 5-E.
Figure 5A:
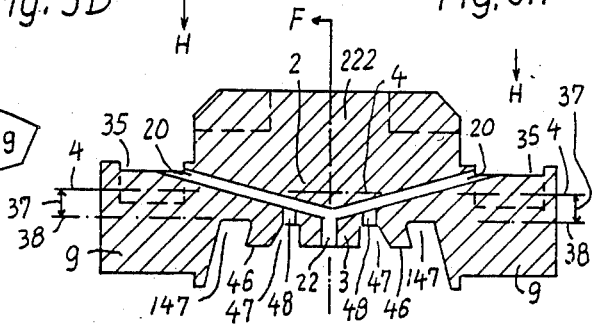
Figure 5D:
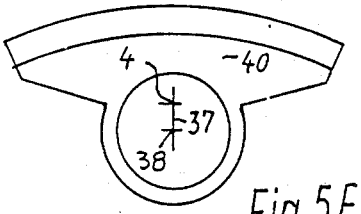
Figure 5C:
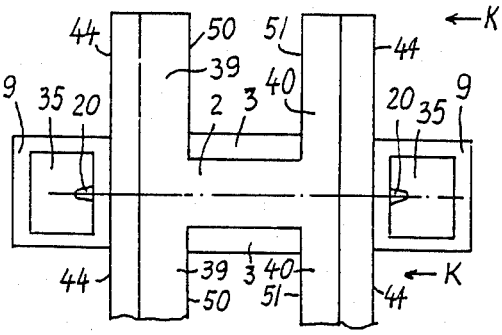
Figure 5E:
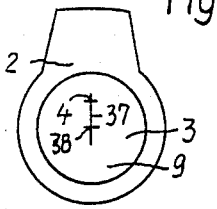

Fig. portion 2A is the section taken through portion 2B along the arrow therein, while portion 2B shows partially the section along arrow V and partially along arrow W of portion 2A. Fig. portion 3A is the longitudinal section, corresponding to arrowed line Y of portion 3B, while portion 3B shows the section along arrowed line X through portion 3A and portion 3C shows the section along the arrowed line Z of portion 3A. Accordingly portion 4A is the longitudinal sectional view partially along line line L—L of FIG. 4B and partially along line LL—LL of FIG. 4B, 4B is the section along L—L of portion 4A, 4C is the view along arrow E of 4B; 4D is the section along D—D of 4B and 4E is the section along A—A of Fig. portion 4B. Fig. portion 5A is again the longitudinal sectional view, while 5B is the section along F—F of 5A, 5C is the view onto 5A from arrow H, 5D the view onto 5C from arrow: K and Fig. portion 5E demonstrates an alternative thereof.

DESCRIPTION OF THE PREFERRED EMBODIMENTS

In FIG. 1 the former art is described by way of example. Rotor 108 has cylinders 106 wherein pistons 105 are reciprocable. The pistons 105 carry a bar 107 which has on its ends rollers 104 which roll along the outward and inward inclined guide faces 102 and 103 of the stroke guide 101.

The characteristic of this former art is, that the piston 105 extends out of the cylinder 106 and out of rotor 108 and has its bar and rollers 104 and 107 radially outward of the cylinder 106 and of rotor 108. When the rollers 104 are rolling along the guide faces 102 or 103, the piston is either moved inward or moves outward in cylinder 106 and rotor 108, but under the inclination of the guide faces 102 or 103 a lateral or tangential component of force appears on the outer portion of the piston 105 which carries the rollers 104. This tangential force appears radially outward of the cylinders 106 and tends to tilt the piston 105 in the direction of the arrows A or B depending on which face 102 or 103 the rollers 104 are sliding at the respective time. The tendency to tilt the piston and the lack of lubrication between the piston and the cylinder wall provide together with the outer location of the power transfer center in the center line of bar 107 radially outward of the cylinder 106 the limitations of the former art which are specified in the prior part of this application.

In the embodiment of FIG. 2, wherein the left portion of the Figure is a longitudinal sectional view through a portion of a multi-stroke device and the right portion of the Figure a cross-sectional view therethrough along the arrow, the rotor 8 has working chambers or cylinders 6.

Pistons 49 are provided in working chambers or cylinders 6 and able to reciprocate therein. The stroke guide 11 is mounted in the housing and has outward and inward guide faces 42 and 43. The stroke transfer body 2 is provided between the pistons 49 and the guide faces 43,44 of the stroke guide 11. The stroke guide 11 is mounted radially of the cylinders or chambers 6, pistons 49 and rotor 8. The arrangement also has inlet and outlet channels and flow control means to control and pass fluid into and out of chambers 6. The guide faces 43,44 form multiple inward and outward faces. So far, the Figure corresponds to the former art and the known former art may be defined, as follows:

In a radial piston device in combination: a housing, a rotor rotatably mounted in said housing, working chambers in said rotor, pistons reciprocable in said working chambers and along wall faces of said working chambers, inlet channels and outlet channels communicated to said chambers and to said housing, a stroke guide provided in said housing and radially of said chambers and pistons for the guidance of the strokes of said pistons, stroke transfer bodies mounted between said pistons and said stroke guide, control means for the control of flow of fluid to and from said working chambers, and multiple inward and outward guide faces on said stroke guide to guide said reciprocable pistons a plurality of times inward and outward in said chambers along said wall faces at each revolution when said rotor revolves.

The invention differs in its basic part from the former art thereby, that it uses a device of the former art, but, a device of the former art,

- wherein fluid pressure pockets are provided in the direction of a lateral load of said piston,
- wherein said fluid pressure pockets are located on peripheral outer portions of said pistons and on portions of said wall faces,
- wherein control portions are provided to control the flow of fluid into said pockets, and,
- wherein said control portions are acting in timed relation to the move of said stroke transfer bodies along said outward and inward guide faces of said stroke guide.

Pockets 30 are the mentioned fluid pressure pockets of the invention; the referentials 10,26 show the peripheral outer portions of the pistons 49 and referentials 13,14 show the portions of the wall faces whereon the fluid pressure pockets 30 are located. Referentials 31,22,3 show the control portions for the control of flow of fluid into pockets 30 and the acting in timed relation to the move of the stroke transfer bodies is a portion of the basic part of the invention, but to materialize this portion of the invention, several solutions may be applied, whereof FIG. 2 demonstrates one of the several possible solutions thereof.

For a further understanding of the Figures of the invention FIG. 2 should now be studied together with FIGS. 3 and 4 and 5 which show specifics which are applied in FIG. 2 and which are basically also applied in a great number of the other Figures. The details are of such sophisticated nature, that they will be better understood when FIGS. 2 to 5 are studied together, because FIG. 2 would become too overcrowded, when all details would be cited by referential numbers therein.

Referring first to the rotor 8 demonstrated in FIG. 3 in sections X,Y and Z, the working chamber 6 may be a radially extending cylinder 6 and be bordered by its walls which form wall faces 13 and 14. The wall faces 13 and 14 which are also a single wall face, extend radially outward to the outer diameter 117 of the rotor 8.

The rotor 8 is however provided with radial extensions 15,16, which are interrupted by the radial outer extension of the cylinders 6 and thereby form radial segments as the mentioned radial extensions 15 and 16. To understand this better, it may be assumed, that the rotor becomes first machined with a bigger diameter 115 and thereafter endwards of the medial radial extensions 15 and 16 the outer ends are machined to provide open spaces or cut offs 17 on both axial ends of the radial extensions 15 and 16, as seen in the left part of FIG. 3. Before the cut offs 17 are machined, however, the chambers or cylinders 6 are machined into the rotor from the outer diameter 115 to the bottom of the respective cylinder 6. At this time of machining also the walls of the chambers 6 are accurately smoothed and dimensioned, in order that they form proper wall faces 13,14, which at this time are still a single cylindrical wall face 13. When however thereafter the machined-offs 17 are cut, the outer portion of the rotor divides into the sections or segments 15 and 16 of the radial extension and the wall face 13 of the cylinder then forms extended wall face portions 13 and 14 along the radial extensions or segments 15 and 16. These wall face portions 13 and 14 are very important matters of the invention and they will become at action of the device also the guide faces, wherealong the pistons are mainly held and guided and they thereby form in actual action piston's guide and support-faces and torque- and power-reception faces.

The rotor 8 may further obtain outcuts 18 on both ends in order to be able to receive therein later during action of the device portions of the stroke transfer bodies or of means, which are associated to the stroke transfer bodies. The medial radial extensions or segments 15,16 may obtain axial end faces 19, which later in action may guide guide means of the stroke transfer bodies or just permit together with the outcuts or end-cut offs 17 the entrance of the medial extensions 15,16 into a room, space, recess or outcut between end portions of the stroke guide 11, when assembled in the housing. Such annular spaces, recesses or like are shown in the left portion of FIG. 2 by referential 27 and are located between the end-portions 52 and 53 of stroke guide 11.

Referring now to the details of the piston, which is demonstrated in detail in FIG. 4, the piston 49 forms a bearing bed 45 for the reception and bearing of the bearing face of the respective stroke transfer body. The bearing bed forms a face 45 of an equal radius, substantially equal to a respective radius of the bearing face of the stroke transfer body and around a centre equal to that of the respective portion of the respective stroke transfer body. The piston 49 is provided with radial extensions 26. In the Figures, where equal parts are appearing on two sides or the like, the other equal parts may be cited by a pre-digital 1 in order to show, that there are two of these parts, but in the description the pre-diget 1 will be left out. Radial extensions 26 form pivot-limitation faces 1 on the inside of the radial extensions 26. These pivot-action limitation faces are very important, because it will be seen later, that without them and without the radial extensions 26 of the pistons 49 it is impossible to achieve the aim of the invention, namely to increase the power, efficiency and torque of the multi stroke devices very decisively. Slight improvements of technologies may be possible by the selection of good materials, good machining accuracies and good designs. But decisive improvements are possible only by the application of proper means of an invention and the here mentioned details of the rotor, pistons and stroke transfer bodies are extremely important parts of the invention for the obtainment of the decisive improvement.

On the radial outer or upper portion of the radial extensions 26 retainers 25 may be provided to retain the respective stroke transfer body in the piston and to prevent an escape of the stroke transfer body from the piston. In certain cases of application it is also suitable to set a distance keeper and holder 54 between the radial extensions 26 and fasten thereby and with the help of retainers 25 the radial extensions into fixed parallelity and rigidity relatively to each other to prevent any deformation of them.

The outer diameter of the piston 49 is shown by the outer face 10 which extends over the entire length of the piston and thereby also over the radial extensions 26 where the face 10 forms the outer face portions 10. The peripherial outer portions of the piston 49 are those close to the outer face 10. They are shown by referential 110. They are mentioned here to make it clear, where the fluid pressure pockets are located.

The fluid pressure pockets 30 are, when they are provided on the piston and not on the cylinder wall, cut through the outer face 10 into the peripheral outer portion 110 of the piston 49 at such place, where the later to be discussed lateral load or tangential load of the piston will appear. The said lateral load acts in FIG. 4 from right to left or from left to right depending on the angle of pivotion of the stroke transfer body in bearing bed 45. In the Figure, the bearing bed 45 is a half of a hollow cylinder configuration and the respective portion of the stroke transfer body of FIG. 5 has a complementary formed bearing face 46, whereby it is assured, that the piston 49 can not revolve relatively to the stroke transfer body.

The passages 31 are cut from the bearing bed 45 to the respective fluid pressure pockets 30. They must be accurately placed, because they form important means of the control of flow of fluid into the fluid pressure pockets 30 in timed relation to the stroke transfer body and the guide faces of the stroke guide. The passages 31 form the second passages. The piston also forms first passages 23 and the recesses 47 form correspondingly the flow control recesses 47. The flow control recesses 47 must connect and communicate the first passages 23 and the second passages 31 at all power strokes of the pistons but it must also cut-off or discommunicate the first and second passages 23 and 31 at opposite, reciprocal or non-power strokes of the pistons. For these reasons the accuracy of setting of the recesses 47 and of the second passages 31 is required. The function of the flow control recesses 47 can also be taken over by the flow control recess bores 29 of FIG. 5.

It should be noted, that the pockets 30 extend radially outwardly wide in the radial extensions or portions 26 of the pistons.

The pistons may also form inclined pivot-limitation faces 7,117 on the first passages 23 or other portions in the bottom portion of the respective pistons 49.

Reference is now made to the very important stroke transfer body of FIG. 5. The portions of the Figure show sections or views as indicated by the arrows and capital letters.

The stroke transfer body has as one of its main portions the bearing portion 3 with thereon the bearing face 46. They are to be borne in the bearing bed 45 of the piston and they are able to pivot in said bed, whereby the said bearing faces 46 are sliding along the face of the bearing bed 45 of the piston. Fluid pressure pockets or recesses 47 may be cut into the bearing portion 3 in order to carry a portion of the radial load of the piston and stroke transfer body and in order to lubricate the mentioned bearing bed and bearing face 45 and 46. The recesses 47 are correspondingly communicated at all times to the first passage 23 of the piston and thereby to the pressure in fluid in the respective working chamber 6.

Other main portions of the transfer body are the radially extending necks 2, which extend radially outwardly from the bearing portion 3 of the transfer body, and the end portions 9.

The ends or end portions 9 extend laterally from the medial portion 3 and are preferred to extend around a second axis 38 which is an eccentric axis relatively to center axis 4 of the bearing bed 45 of piston 45 and of bearing portion 3 of the transfer body.

A radially inward directed eccentricity 37 is provided between the concentric axis 4 and the eccentric axes 38. This is important, because without it the aim of the invention of transfer body of FIG. 5 can not be easily obtained. The ends 9 may be cylindrical bars around the eccentric axes 38. Axis portions 38 are provided on the same axis 38 but do not appear in the medial portion 3, but only in the end portions 9. The end-bars 9 may have cylindrical outer faces to be able to carry members thereon. The mentioned members 36 may be rollers or rings 36 of FIG. 2. Theoretically it is possible and in practice it is also possible to set roller or ball bearings instead of the rings 36 of FIG. 2 onto the cylindrical outer faces of ends 9. However, such ball- or roller-bearings have only limited load capacity and are not very strong to obtain a maximum of transfer of load or forces. The rings of FIG. 2 in combination with the stroke transfer body of FIG. 5 are capable of carrying a higher load and they are more reliable in practical operation than ball-bearings or roller bearings because the ball- or roller-bearings might break quickly under overload.

In order to obtain a smooth running without wearing and with small friction of the rings or members 36 of FIG. 2 along the outer faces of ends 9, the fluid pressure pockets 35 are provided. The pockets 35 receive fluid under pressure by passages 20,22 and 23 from the respective chamber 6. The passages 20 and 22 are visible in G of FIG. 5. They are also visible in H of FIG. 5 and their location is further visible in the right portion of FIG. 2. The pockets 35 are commonly radially outward directed in ends 9, vut when a device is supposed to revolve in one single direction, it is suitable to displace them angularly in a direction normal to the respective stroke guide faces 42 or 43 respectively. In devices for both rotary directions such displacement is not easily to be done. The direction of the pockets 35 to be normal to the inclination of the respective guide face 42 or 43 is generally desired and even required for an almost perfect operation. But for double directional devices, the desired complete perfection can not yet be obtained. It is, however, partially obtained and assisted additionally by the pivotion of transfer body 2,3 in the piston, which will be later discussed. This pivotion turns the neutrally radially outward direction of the pockets 35 in a direction towards the normal direction to the inclination of the guide face 42 or 43. How far this turning in this direction by said pivotion is done, is a question of the actual design and depends on the angle of the faces 1 and 12 of piston and transfer body portion 2. It is illustrated in the right portion of FIG. 2.

The bearing portion 3 contains further the flow control recesses of flow control bores 29 and/or 47.

The transfer body may further be provided with guide portions 39 and 40 which may have guide faces and 44 axially outwards and guide faces 50 and 51 axially inwards of the guide portions 39 and 40. The guide faces 50 and 51 would then serve for the purpose of guiding the piston extensions 26 with their end faces 55 on the inner faces 50 and 51 to prevent rotation of the piston relative to the transfer body. The axially outer faces 42–44 would then be guided portions of the housing or portions of the stroke Guide 11. The guide portions 39 and 40 with the axial inner guide faces 50 and 51 could then also serve to guide the transfer body by the inner faces 50 and 51 of the guide portions 39 and 40 along the end faces 19 of the extensions 15 and 16 of the rotor 8. In order to prevent departure on the axis 4 and of axes 38 from parallelity to the axis of the rotor 8 and of stroke guide 11, because a misalignment of the direction of axes 4 and 38 might disturb the device and the part-cylindrical beds would function improperly when such unparallel direction of axes 4 and 38 would occur.

The neck 2 is provided with pivot-action limitation faces 12,112 whereby the neck becomes a pivot-angle limitation means or an eccessive pivotion stopper or preventer. At the same time however, the neck 2 is a radial stabilizer, because it strengthens the radial bearing capacity of the therebelow present bearing portion 3 in radial direction and thereby prevents radial deformation of the ends 9. It thereby increases the radial pressure capability of the transfer body.

As seen in F of FIG. 5, the limitation faces 12 are inclined relatively to each other to make the neck 2 narrower radially outwardly. This is required to permit the bearing portion 3 and neck 2 to pivot in the bed 45 and in piston 49.

It is important to note, that the angle of inclination of limitation faces defines the maximum of the angle of pivotion of the transfer body. At the said maximum angle of pivotion one of the limitation faces 12 or 112 bears and seats on the respective limitation face 1 of the radial extension 26,126 of the piston 49. Instead of providing the pivot angle limitation by the neck 2 it is also possible to provide a radially inwardly extending neck of portion 5 into the passage or recess 23 in the bottom portion of the piston 49 as shown by inner neck 5 in FIG. 2. Inner neck 5 then bears on limitation face 7 and thereby limits the angle of pivotion. Depending on the actual situation either the outer neck 2 or the inner neck 5 is provided, or both of them are provided to act in unison.

An other important matter is the downwardly or radially inwardly directed distance or eccentricity 37 between the concentric axis 4 and the eccentric axes 38. Axis 4 will be a point, when ball-part formed beds and bearing faces are provided, but the distance 37 in the mentioned direction will be the same as in the present figures.

This eccentricity 37 is required for the purpose of actuating a pivot-movement of the transfer body. Because without a pivot-motion the first and second passages 23 and 31 can not communicate and discommunicate. The control recess 29 or 47 would then be stationary and could not control the flow of fluid.

Since there is the eccentricity 37 in the invention, the radial outwards directed force out of fluid in pressure in chamber 6 grasps the transfer body in the medial center 4. But the resisting or acting forces of the guide faces 42,43 of the stroke guide act on the transfer body more radially inwardly, namely on the center 38. Thereby, as soon as the transfer body moves along an inclined guide face 42 or 43 and pressure is present in chamber 6, the inclination of the faces 42,43 moves the axis 38 laterally or tangentially in the piston 49 and thereby pivots transfer body 2,3 around the centric axis 4 until the limitation faces 12,1 or 5,7 meet and stop and prevent a further increase of the angle of pivotion.

Commonly the pivotal movement of the transfer body takes place at the meeting of the ends of the stroke guide faces 42 and 43 and the resistance to the pivotal movement is provided solely by the meeting of the mentioned limitation faces 1 and 12 or by the meeting of portion 5 with the limitation faces 7 or 117.

Between the outward and inward inclined guide faces 42,43 of the stroke guide 11, there are meeting points, faces or areas between meeting faces 42 and 43. These are the turning or neutral areas. As soon as the transfer body or its member 36 has moved over such turning area it meets a respective inclined guide face 42 or 43. When then pressure is present in chamber 6, the pressure forces the piston 49 radially outward against the inclined guide face 42 or 43. The inclination of the guide faces 42 or 43 immediately divide the force of the piston 49 into two forces of components of forces, namely one in radial direction on the other in lateral or tangential direction, which is the direction normal to the radial direction of the radially directed force on the piston's bottom. The bearing portion 3 can not move laterally in piston 49 because it is stably borne in the bearing bed 45. Since however, the distance 37 or eccentricity 37 is present between the center 4 and the axes of the ends 9, the ends 9 can swing in the direction of the arrow 60 in FIG. 7 or in the contrary direction or in the direction of angle 24 of FIG. 2, right portion of the Figure, or in the contrary or opposite direction. This swing or pivotion is a displacement substantially in the lateral direction of the lateral component of forces of the eccentric axis 38 and thereby of the end members or ends or end parts 9. The displacement of them in the said lateral direction under the force of the lateral component of forces is 58 in FIG. 7 or the lateral distance of axis 38 in the right portion of FIG. 2 from the center line 59 of piston 49. The lateral displacement 58 is in practice the pivotion of the transfer body into its maximal angle 24 of pivotion at which the stopper or limitation faces 1 and 12 or 5 and 7 meet and stop on each other.

How the pivotion is actuated and stopped at the maximaum angle gamma or 24 is now understood and attention is now requested to the right portion of FIG. 2. Therein on the left part is shown in section along the line W W but the right portion is shown along the sectional line V—V of the left Figure of FIG. 2. Thereby in the right side the inclined guide face 42,43 is directly visible and visible is there also the engagement and rolling of member 36 along the inclined guide face 42,43. The tangential or lateral force component 33 is now almost or directly in the center line 4 and the fluid pressure pocket 30 in the left side is practically symmetrically laid around the center line or axis 4. Thereby the component of forces, which is the lateral component 33 of forces acts on the arm 34 of moment 33×34 and supplies a torque 33×34 into the pressure pocket 30 and thereby by pressure in fluid directly in the center line 4 against the wall face 13 or 14. Thus, the torque is not transferred any more by mechanical touch, but in its major portion by the force of the fluid column 32 in fluid pressure pocket 30. Such actuation of torque onto a rotor is an action under the lowest possible friction and therefore a most effective means to transfer a torque on rotor 8, namely the aim and object of the invention. The mechanical friction of transfer of torque or force by mechanical means is thereby prevented or drastically reduced by this invention. This would however not have been possible without the control means to control the flow of fluid into the pocket 30.

It might also be noted from the right portion of FIG. 2, that the piston extends radially inward and outward practically equally long from the centre 4. Thus, the piston 49 of the invention is not attached any more to the tilting tendency of arrows A or B of FIG. 1 of the former art, because the action of force does not take place any more outwardly and distant from the guide of the piston but practically directly in the middle of the piston and in the middle of the guidance of the outer face 10 of piston 49 along the guiding wall face 13,14 of the radial extension 15,26 of the rotor 8. Thus, any former tilting tendency, which the pistons were subjected to in the former art, is prevented by the means and arrangements of the invention. The bearing faces 46 are at rest on the bearing beds 45 of the pistons, once they have pivoted and that resting is maintained over the most of the length of the respective power stroke. Consequently there is practically no friction between bearing faces 46 and bearing beds 45 at the power strokes, when the little friction during the short times of pivotion is neglected.

The radial fluid pressure pockets 35 on the ends 9 are capable to carry a very high load. The arrangement of the invention of the Figures are therefore capable of very high pressures in fluid, for example of a couple of hundreds of atmospheres or quite a number of thousands of psi.

Figure 6:
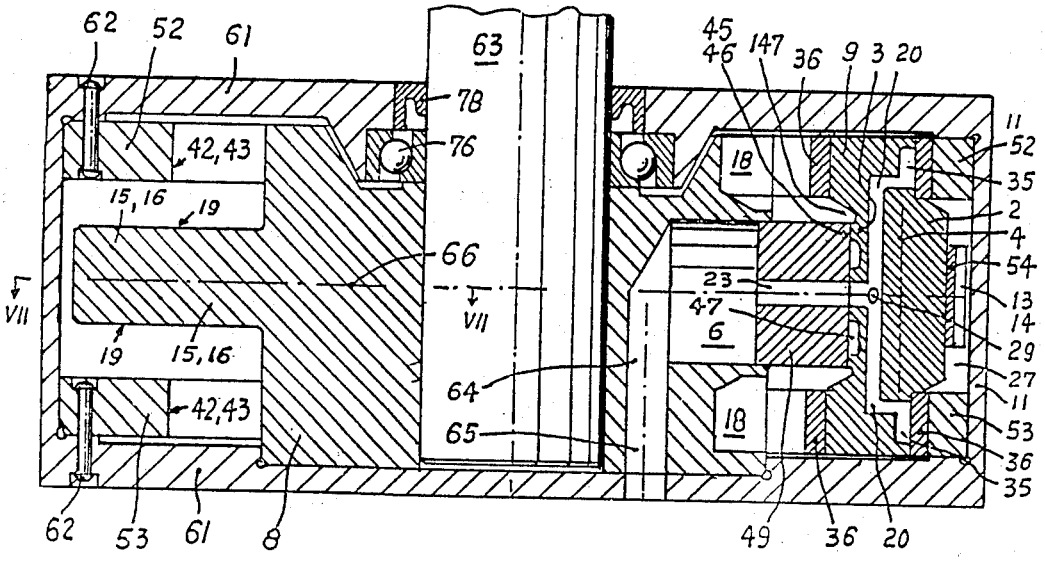
FIG. 6 is a longitudinal sectional view through an embodiment.
Figure 7:
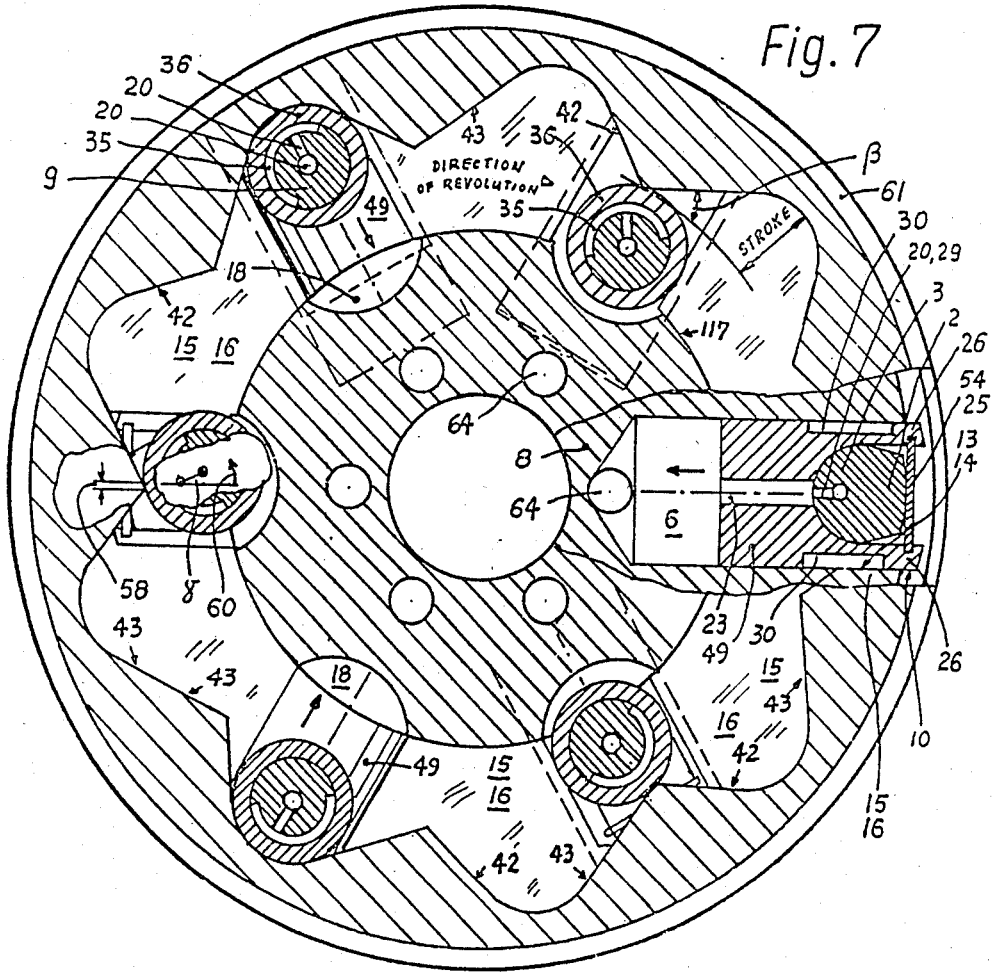
FIG. 7 is a sectional view through FIG. 6 along line VII—VII.

FIGS. 6 and 7 demonstrate the arrangement of the means of FIGS. 2 to 5 in a complete device. In this case the one-directional type is demonstrated, which shows a slight difference of inclination and location of the inclined guide faces 42 and 43. The pockets 35 are slightly angularly turned as suitable for one directional rotation as earlier explained. The multiplicity of the guide faces 42,43 is clearly visible and the space or recess between the end portions 53,52 of stroke guide 11 is obtained by mounting just end portions 52 and 53 into the housing. 61. The Figures show the parts which were discussed.

FIG. 7 is a sectional view through FIG. 6 along the radial medial face 66. FIG. 7 demonstrates also the very large piston strokes, the angle of rotation and by arrows whether the pistons at the respective location move inward or outward. The Figures demonstrate a device with 6 chambers and pistons and nine strokes inwardly and outwardly of each piston at each revolution. There are consequently nine inward guide faces and nine outward guide faces 42,43. As far as numerals are appearing which have not yet been discussed, they are commonly known or applicable matters, such as for example holders 62 to fasten the stroke guide end portions 52,53 on the housing 61 or to fasten the stroke guide 11; or a shaft 63 in the rotor 8 or channels 64 to pass fluid from ports 65 to chambers 6 and vice versa.

At the actual size of the Figures the 24 mm diameter pistons give power strokes of about 15 mm in the device of an outer diameter of 160 mm and a weight of less than 40 lbs. At 300 atmospheres, that gives a theoretical torque of $24^2$ pi/4=452 mm square=0.52 cm square×300 Kg=1.357 Kg×3 pistons in power stroke×4.071 Kg×0,062 meter arm of torque×252 kilogram meter multiplied by the rate of lateral component. The lateral or tangential component is defined by the inclination of the guide face 42,43 at the power stroke and is the calculated radial force multiplied by the tangent of angle of inclination beta as shown in FIG. 7. At an angle beta of 30 degrees as about in the FIG. 7, the torque now becomes 252×0,57=about 145 kilogrammmeter multiplied by losses of torque by mechanical friction, which are relatively small. They are between 4 and 12 percent, depending on speed of rotation. At low revolution the mechanical efficiency may be calculated to be about 95 percent, giving 5 percent loss from the above calculated sample of torque. That is about 138 Kgm and indeed a very high torque for such a small diameter motor. The rotor 8 and the shaft 63 have to be of strong material to be able to handle the high torque which the small device produces. It should be noted here, that the calculated force of 4071 Kg acts on only three pistons and that multiplied by the tangent 0.75 gives 2348 Kg divided by 3=about 780 kg tangential force per piston. It will be easily understood that such small pistons could not carry this high load on the wall faces of the cylinders, when the former art of FIG. 1 would be applied instead of the means of the invention. The pistons of the former art would quickly stick and disturb the device with such load in such small size.

Figure 8:
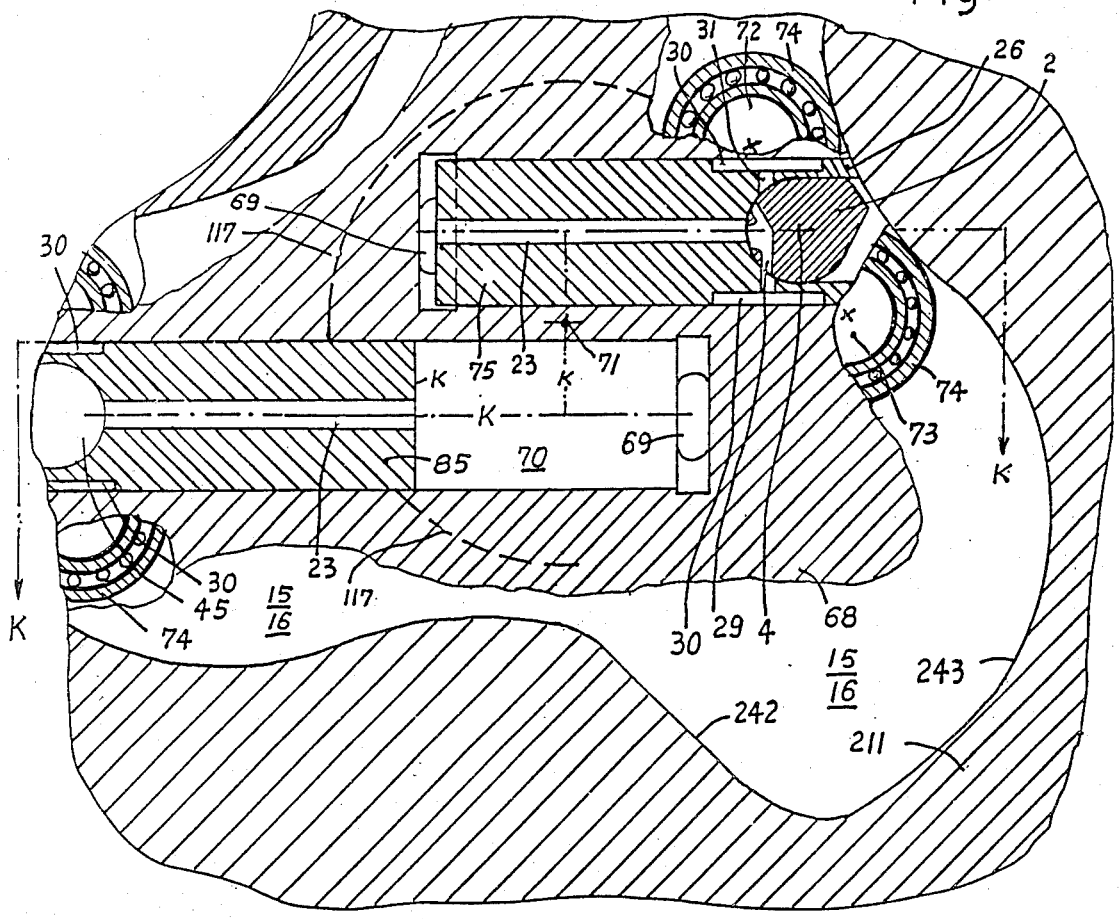
FIG. 8 also shows a longitudinal sectional view through an embodiment.
Figure 9:
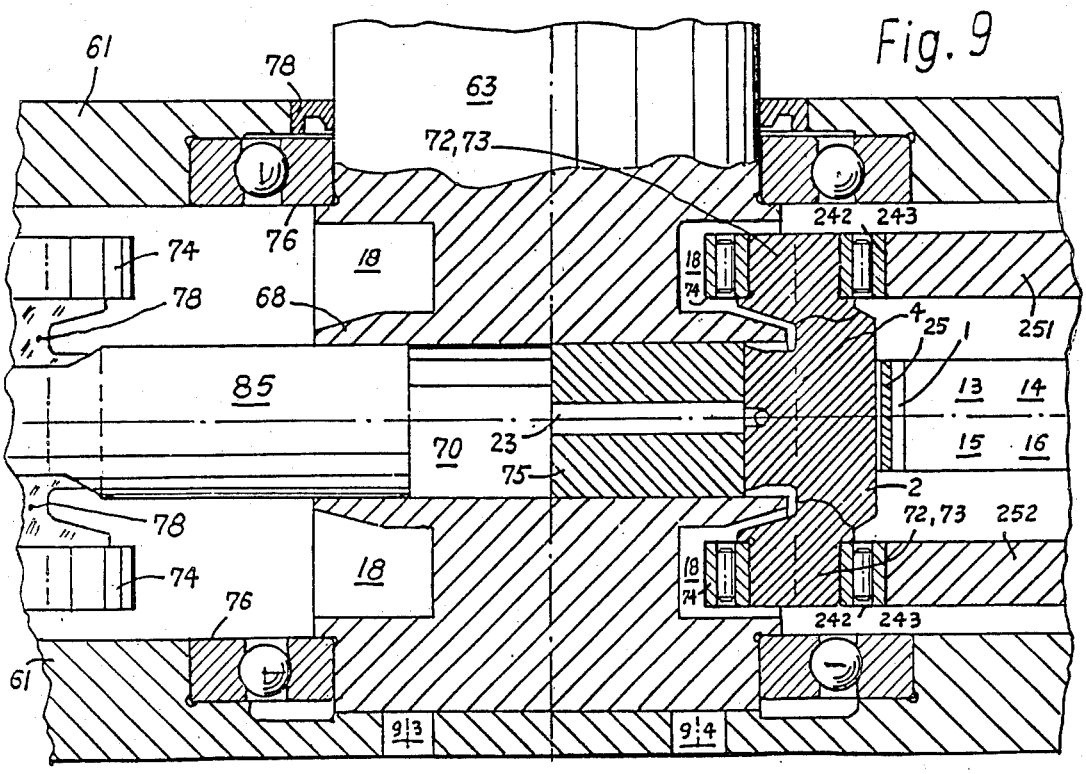
FIG. 9 is a sectional view through FIG. 8 along line K—K.

FIGS. 8 and 9 demonstrate another embodiment of the invention which illustrate at the same time two different means of the invention. FIG. 9 is a section along line K—K of FIG. 8.

First the embodiment illustrates another possibility of a different stroke transfer body, whereby the limitation faces 1 and 11 can be spared. The neck 2 has here axial extensions 78 which replace the ends 20 and the axial extensions 78 carry distanced from the middle in peripheral direction or in the direction of rotation two pairs of rollers 74. Each pair of rollers 74 has a forward roller and a rear roller on a forward holder 73 and on a rear ward holder 72. Since the load is now carried by four rollers instead of by only two rollers, the rollers may now be ball or roller bearings 74. This arrangement of the first embodiment in these two Figures eliminates the requirement of pivot-angle limitation, because the forward and rear rollers 74 define the angle of pivotion when they are running along the respective inward or outward guide faces 242 or 243 of the outer portions 251,252 of the stroke guide 211. The recesses and passages for flow control to pockets 30 can be the same as in the embodiments of the previous FIGS. 6 and 7 etc..

The second embodiment of the invention in FIGS. 8 and 9 is the provision of cylinders or chambers 70 spaced away from the medial center 71 of the rotor 68. These chambers 70 extend beyond the middle 71 deeply into the rotor 68 and almost to the opposite diametrical outer face 117 of the rotor. The pistons can thereby do a very long stroke, times longer than in the previous FIGS. 6 and 7. This is seen by pistons 75 and 85 whereof 75 has an innermost and piston 85 has an outermost location. Channels 69 are the channels for the transfer of fluid into and out of chambers 70. Bearings 76 carry the rotor 68 and a shaft seal 78 may be provided. Other details are known from the description of the other Figures or from my elder patents.

Figure 10:
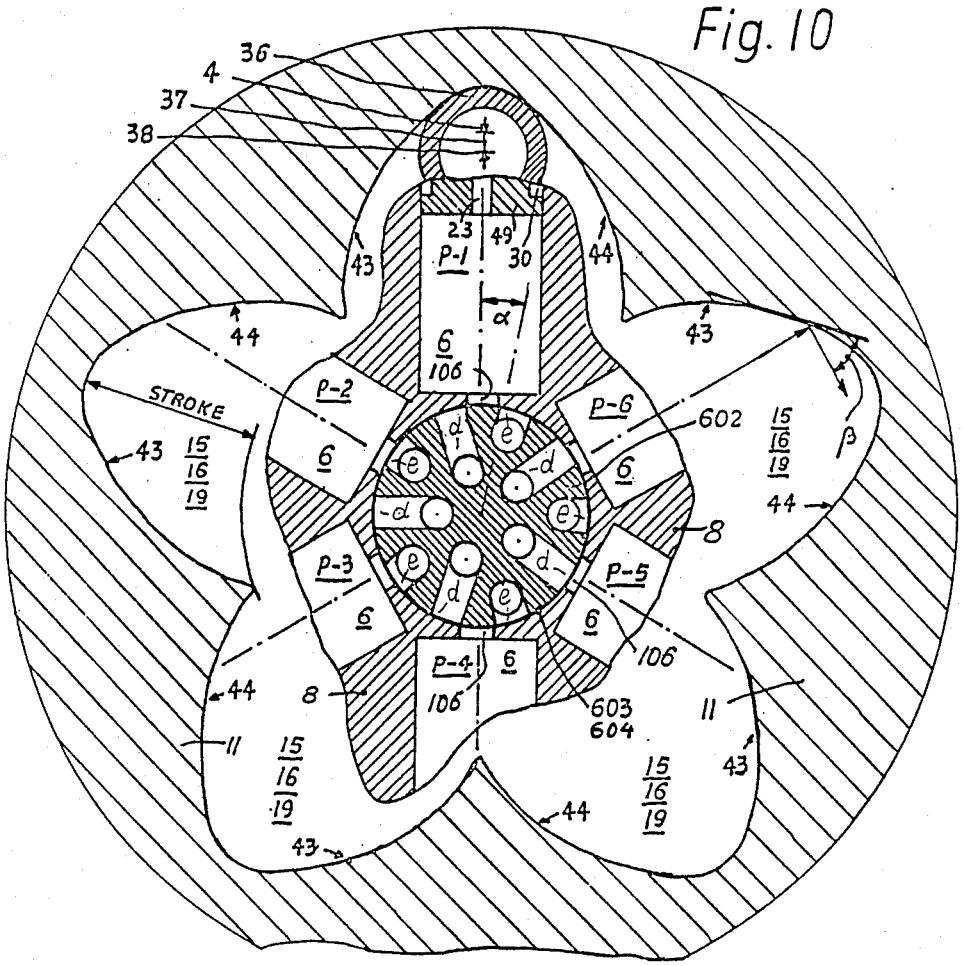
FIG. 10 is a cross-sectional view through another embodiment.

The embodiment of FIG. 10 shows inclined outward and inward guide faces 43 and 44 of an angle of 45 degrees relatively to the radial axis through the respective cylinder. There are five strokes per piston and revolution in this Figure. The rotor 8 of this figure has six working chambers or cylinders 6. The pistons or chambers are cited by P-1 to P-6. The angle of rotation of the first cylinder 6 is defined by the angle between the vertical medial face through the device and the radial center line of the first chamber or piston 6,29, and named "alpha". The angle of inclination of the respective guide faces 43,44 is called "beta" and it is seen in FIG. 12, that a face of permanent inclination gamma of 45 degrees relatively to the radial center line through the cylinder and piston is not a straight 45 degree face, but actually a curve. The Figure illustrates also the component of the tangential or lateral force 601 which is at 45 degrees angle beta the value 1. or equal to the radial force. When the angle beta would be still steeper, for example sixty degrees in this Figure, the lateral component of forces would exceed the ratio 1 and become at said degrees for example 1.73. This shows, that the selection of the angle of inclination "beta" can even make the lateral component of forces larger than the radial component of forces. The force out of the fluid pressure pocket 30, which creates the torque on the wall faces and thereby on the rotor, can then be bigger than the radial force below the bottom of the respective piston. It is seen here, that extremely high torque can be produced by the invention. The sizes of the pressure pockets 30 must be accordingly dimensioned. For beta sixty degrees the cross-ectional area through pockets 30 must be much bigger than for thirty degrees beta-angle.

The FIG. 10 also shows, that a very large piston stroke is obtainable by this Figure. It is in the Figure about 18 percent of the outer diameter of the device.

Figure 11:
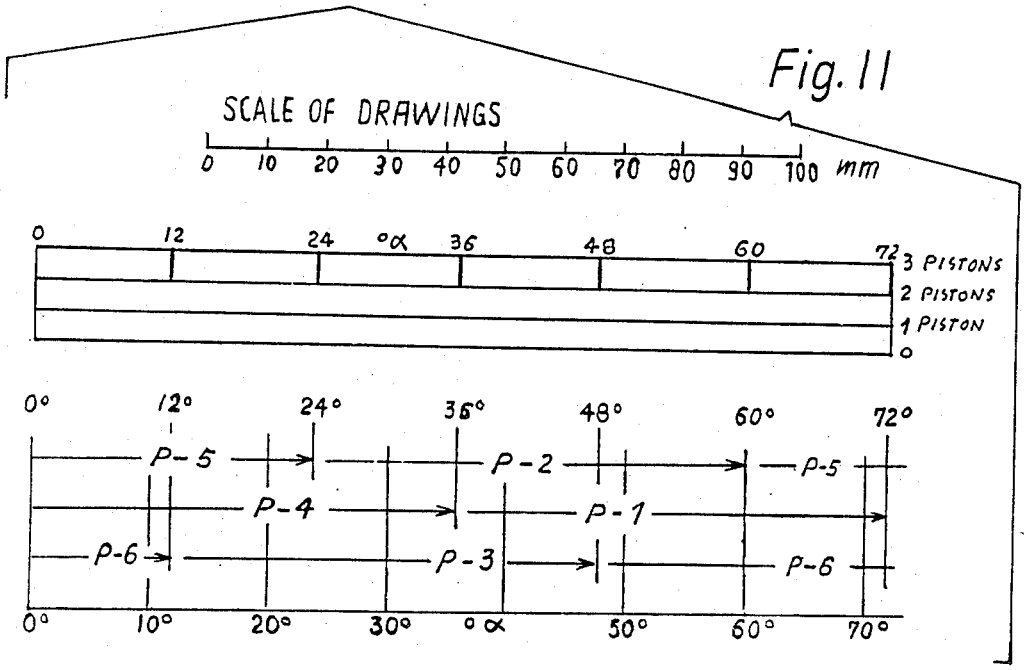
FIG. 11 is a schematic to explain actions of FIG. 10.

FIG. 11 shows which pistons act at what time in power-strokes, when the device is a motor, revolves clockwise in FIG. 12 and the outward faces 43 are thereby power stroke faces, but faces 44 are then inward or opposite or non-power stroke faces. The bottom diagram of FIG. 11 makes the timed control of flow to and from cylinders 6 over rotary angle alpha visible. The motor or device may have axial flow to the chambers, as in some of the previous Figures, but in FIG. 10 a radial flow through cylindrical control body 602 is shown. The outer face 603 of the control body is fitted into the inner face of the rotor 8 which forms the rotor hub and the rotor 8 revolves around the stationary control body 602. Narrow rotor passages or channels 106 extend from chambers 6 inwards through the rotor to and through the inner face 604 to slide along the entrance and exit ports. The entrance ports are cited by the referential "d" indicating flow delivery ports and the exit ports are cited by referential "E" indicating exit ports. Every outward stroke guide face 43 is radially of a delivery port "d" and every inward stroke guide face 44 is radially of an exit port "e". Thus, there must be as many delivery and exit ports as there are strokes of each piston per revolution of the rotor 8. The combination of 6 chambers with 5 strokes gives a very uniform torque, which is demonstrated in the upper diagram of FIG. 11. Care must be taken, that there does not appear dead-time at change from power- to non-power-strokes. This can be done by respective configuration of the corners between power- and non-power or inward and outward guide faces, or the moment of no-torque of one of the three pistons can be accepted, when the application permits it.

On top of the schematics or diagrams of FIG. 11 is a scale, which is valid for all of the Figures. Therefrom the actual measures can be obtained also when the drawing will be printed in the patent in a reduced scale.

The data of stroke=18.5 percent of the outer diameter of the device together with the value piston diameter=11 percent of the outer diameter gives a possibility to see immediately the maximum of torque obtainable in such 45 degrees motor, regardless of the outer size of the motor. Steeper inclinations of the guide faces with high angles beta give much higher torque but should be run only at lower rpm. When higher rpm are desired, the inclinations of the guide faces of the stroke guide should be kept softer.

What is claimed, is:

1. In a radial piston device in combination: a housing, a rotor rotatably mounted in said housing, working chambers in said rotor, pistons reciprocable in said working chambers and along wall faces of said working chambers, inlet channels and outlet channels communicated to said chambers and to said housing, a stroke guide provided in said housing and radially of said chambers and pistons for the guidance of the strokes of said pistons, stroke transfer bodies mounted between said pistons and said stroke guide, control means for the control of flow of fluid to and from said working chambers, and multiple inward and outward inclined guide faces on said stroke guide to guide said reciprocable pistons a plurality of times inward and outward in said chambers along said wall faces at each revolution when said rotor revolves;

wherein fluid pressure pockets are provided in the direction of a lateral load of said pistons, wherein said fluid pressure pockets are located between peripheral outer portions of said pistons and portions of said wall faces, wherein said stroke transfer bodies are pivotably borne on bearing beds on said pistons to permit pivotion of said bodies around center axes which are normal to the axes of said pistons and parallel to the axis of said rotor, wherein said stroke transfer bodies have ends with an ability to move along said outward and inward guide faces of said stroke guide, while said ends have portions with second axes parallel to said center axes but eccentrically distanced therefrom with said second axes pivotable about said center axes and caused to pivot about said center axes under the play of forces which are exerted onto said ends of said transfer bodies and onto said transfer bodies by the pressure in fluid in said working chambers and by the movements of said ends along said inclined guide faces, wherein said pivotion runs through angles of pivotion between pivot angle limitations which are formed by said bodies and said pistons, wherein control portions are provided on said stroke transfer bodies and said pistons to control the flow of fluid through passages into said pockets, and, wherein said control portions alternately open and close said passages in dependency of said angles of pivotion and thereby in timed relation to the movement of said stroke transfer bodies along said outward and inward guide faces of said stroke guide.

2. The device of claim 1, wherein said stroke transfer bodies extend axially in both directions beyond said pistons, to form stroke transfer ends, wherein said ends form pairs of bearing portions, while said bearing portions of each pair form one forwardly located bearing portion and one rearwardly located bearing portion, and each of said bearing portions carries a rolling member, whereby four rolling members associated to each respective piston and transfer body are rolling along pairs of inward and outward guide faces of said stroke guide in order to define by said rolling under the influence of the configuration of said guide faces of said stroke guide the inclination of pivotion of said transfer bodies and thereby provide and control said flow of fluid into said pockets and said action in said timed relation of said control portions.

3. The device of claim 1, wherein said stroke transfer bodies have ends which carry members with an ability to move along said outward and inward guide faces of said stroke guide.

4. The device of claim 3, wherein said members are laterally distanced from the respective longitudinal axis of the respective piston of said pistons.

5. The device of claim 1, wherein said inward or outward guide faces of said stroke guide form angles of inclination relatively to the radial axes of said working chambers in the range of twenty to sixty degrees, and, wherein fluid pressure pockets provided along portions of the outer faces of said pistons and the wall faces of said chambers are suitably sized and located to be able to carry the major portion of the tangential load transferred from said inward- or outward guide faces of said stroke guide to said pistons, whereby said device is able to handle an extremely high torque by said rotor in a given weight and size of the device.

6. The device of claim 5, wherein said fluid pressure pockets are suitably dimensioned and located to permit said device to handle said extremely high torque at a high efficiency.

7. The device of claim 1, wherein said stroke transfer bodies have ends of cylindrical outer faces to carry thereon revolvable rollers which roll with their outer faces along said guide faces of said stroke guide, and, wherein fluid pressure pockets are provided in said ends, extending through said cylindrical outer faces into said ends of said transfer bodies, while said fluid pressure pockets in said ends are provided on said ends in a radial outward direction with respect to the neutral, non-pivoted position of said transfer bodies, whereby said fluid pressure pockets in said ends pivot with said transfer bodies and thereby act at all times when they are communicated through said control portions to said passages in a direction which is substantially equal and opposed to the direction of the load which appears on said rollers during said power strokes.

8. The device of claim 7, wherein said bearing portions are provided with flow-control recesses which interrupt said bearing faces, wherein said pistons are provided with first passages to extend from said working chambers through said pistons into said recesses, wherein second passages are provided through portions of said pistons to extend from said bearing beds to said pockets, wherein said second passages are located at definite places in order that said control recesses are able to alternately open and close said second passages when said bearing portions pivot in said beds, and, wherein said flow-control recesses communicate said first and second passages when said pistons do power strokes when they oscillate in said working chambers;

whereby the lateral forces acting during said power strokes on said pistons are at least partially carried by pressure in fluid in said pockets when said passages are communicated by said recesses.

9. The device of claim 8, wherein said flow control recesses communicate said first and second passages through said piston and thereby said pockets with said working chambers when said pistons do outward strokes at said reciprocation in said working chambers, wherein fluid under pressure is led into said working chambers at location of said working chambers and pistons below said outward guide faces of said stroke guide, whereby said fluid under pressure forces said pistons in said chambers outward and said stroke transfer bodies along said outward stroke faces to revolve said rotor, whereby said device acts as a motor, and, wherein said pockets transfer the force and pressure in fluid against the respective portions of said wall faces, whereby the torque of said motor is transferred by fluid pressure in said pockets, acting against said wall forces.

10. The device of claim 1, wherein said rotor is provided with radial extensions, wherein said rotor has radially reduced outer diameters endwards of said extensions, wherein said extensions form extended working chamber wallfaces to form thereby extended piston-stroke guide faces, and, wherein the outer faces of said pistons are at least partially and temporarily moved and guided along said guide faces of said radial extensions.

11. The device of claim 10, wherein said wall face portions form piston-guide- and support-faces, whereby they also form torque- and power-reception faces, said extensions and segments of said rotor form torque-transfer portions and said fluid pressure pockets form torque-thrust- and transfer-means.

12. The device of claim 10, wherein said extensions extend between endwardly located faces of said outward and inward guide faces partially beyond said guide faces into a space provided between portions of said stroke guide and said endwardly located faces.

13. The device of claim 10, wherein said stroke guide includes a medial portion and end portions on the ends of said medial portion, wherein said guide faces of said stroke guide are provided on said end portions, wherein said medial portion provides a recess extending beyond said guide faces radially into said stroke guide, wherein said radial extensions of said rotor at least temporarily enter into said recess in said medial portion, wherein said stroke transfer bodies have medial parts and end parts on the ends of said medial parts, wherein said medial parts include power-transfer centers, wherein said power transfer centers are located in said pistons and at the major portion of the strokes of said pistons between said radial extensions of said rotor, and, wherein said end parts of said stroke transfer bodies carry engagement means to engage said guide faces of said stroke guide and to guide said power transfer bodies and said pistons substantially parallel to said outward and inward guide faces of said stroke guide.

14. The device of claim 13, wherein said engagement means are rolling rings with cylindrical inner and outer roller faces, wherein said end parts are cylindrical bars with cylindrical outer faces of a configuration complementary and fitting to said inner faces of said rolling rings, wherein said end parts of said stroke transfer bodies contain fluid pressure pockets communicated by passages through portions of said stroke transfer bodies to said medial part and through said medial part to a space which contains fluid under pressure, whereby said outer roller faces roll along said guide faces and said inner roller faces slide along said end parts and are at least partially radially borne by pressure in fluid said pockets in said end parts of said stroke transfer bodies.

15. The device of claim 1, wherein said stroke transfer bodies include bearing faces of a configuration complementary to the configuration of said bearing beds, and, wherein said bearing faces are slidably borne on said bearing beds.

16. The device of claim 15, wherein said bearing faces are shorter than the diameter of the pistons;

wherein said bearing faces are provided on bearing portions of said stroke transfer bodies, wherein said bearing portions are shorter than the diameters of said pistons, and, wherein said bearing portions and said bearing faces are located within the outer diameters of said pistons.

17. The device of claim 16, wherein said bearing portions and said bearing beds are at least partially and temporarily entering into said working chambers in order to provide the possibility of large piston strokes.

18. The device of claim 15, wherein said bearing beds are provided with radially outwardly extending face portions, wherein said pistons are provided with radially outwardly extending piston portions, wherein said face portions are partially provided on said piston portions, wherein said bearing portions of said stroke transfer bodies are provided with radially extending necks, wherein said radially extending necks are partially narrower than the distance between said radially extending face portions, and, wherein said necks are able to pivot in a limited extent between said face portions of said piston portions.

19. The device of claim 18, wherein said neck and its configuration in combination with said face portions and said piston portions define a definite limit of the angle of pivotion of said neck between said face portions, and, wherein said necks are kept by said face portions and said piston portions in their maximum of pivotal direction when said stroke transfer bodies move along a respective outward guide face of said stroke guide, whereby said maximum of pivotal direction is maintained by said stroke transfer bodies at said moving along said respective outward guide face.

20. The device of claim 18, wherein said stroke transfer bodies and said necks are utilized to define and actuate said control portions for said control of flow of fluid into said pockets.

21. The device of claim 18, wherein said stroke transfer bodies carry members which move along said guide faces of said stroke guide, wherein said transfer bodies and said pistons have a center of pivotion, wherein said members which move along said faces are mounted around a radially inner axis of parallelity to the axis of said rotor, and, wherein an eccentricity extending radially inward from said center of pivotion is provided between said center of pivotion and said radially inner axis.

* * * * *